US005417443A

United States Patent [19]

Blattner et al.

[11] Patent Number: 5,417,443

[45] Date of Patent: May 23, 1995

[54] SNOWBOARD BINDING

[76] Inventors: Jacob A. Blattner, 1547 Jefferson St., Madison, Wis. 53711; David R. Hubatch, 113 S. Page St., Stoughton, Wis. 53707

[21] Appl. No.: 115,505

[22] Filed: Sep. 1, 1993

[51] Int. Cl.[6] ..... A63C 5/03; A63C 9/12

[52] U.S. Cl. ..... 280/14.2; 280/611; 280/618

[58] Field of Search ..... 280/14.2, 611, 618, 280/620, 623, 624, 633, 634; 441/70, 74

[56] References Cited

U.S. PATENT DOCUMENTS

| | | | |
|---|---|---|---|
| 2,754,526 | 7/1956 | Bridges | 280/633 X |
| 4,871,186 | 10/1989 | Klosterman | 280/611 |
| 4,871,337 | 10/1989 | Harris | 441/70 |
| 4,915,400 | 4/1990 | Chambers | 280/14.2 |
| 4,969,655 | 11/1990 | Katz | 280/14.2 |
| 4,973,073 | 11/1990 | Raines et al. | 280/14.2 |
| 4,979,760 | 12/1990 | Derrah | 280/14.2 X |
| 5,143,396 | 9/1992 | Shaanan et al. | 280/14.2 X |
| 5,172,924 | 12/1992 | Barci | 280/14.2 |
| 5,190,311 | 3/1993 | Carpenter et al. | 280/14.2 |
| 5,261,689 | 11/1993 | Carpenter et al. | 280/14.2 X |

FOREIGN PATENT DOCUMENTS

| | | | |
|---|---|---|---|
| 2645036 | 10/1990 | France | 280/14.2 |
| 18529 | 1/1904 | Sweden | 280/611 |

OTHER PUBLICATIONS

Advertisement for Business Snowboard for Business D. F. B. Binding, *Transworld Snowboarding Magazine,* Oct. 1993, page unknown.

Advertisement for Perogies Binders by Westbeach, *Transworld Snowboarding Magazine,* Jan. 1994, page unknown.

*Primary Examiner*—Brian L. Johnson

*Attorney, Agent, or Firm*—Quarles & Brady

[57] ABSTRACT

A snowboard binding may be mounted to a pair of mounting holes provided in a snowboard in a position and at an angle preferred by the rider. The binding is attached to the snowboard at a pair of base parts that are not interposed between the rider's foot and the snowboard. The base parts each include an opening therethrough and a pair of securable posts, with one post being fixed to either side of the opening. A pair of locking plates, slidably securable to the base parts, are adjustably mountable. Each locking plate includes a pair of collinear slots slidably engagable on the posts of the base parts and a third slot located between and substantially perpendicular to the collinear slots and situated such that, when the locking plates are slidably secured to the base, each locking plate may be removably fastened to the snowboard by passing a fastener through the third slot and through the opening into one of the mounting holes.

6 Claims, 3 Drawing Sheets

SNOWBOARD BINDING

FIELD OF THE INVENTION

The present invention relates generally to binding devices for securing a shoe or boot to a snowboard, and particularly to an adjustable binding device for a snowboard.

BACKGROUND OF THE INVENTION

Snowboards are a recently developed alternative to skis for winter recreation. Envisioned as something of a hybrid of a skateboard, a surfboard, and a water ski, a snowboard allows a rider to traverse downhill snow-covered slopes or to perform freestyle stunts on the snowboard.

A snowboard rider negotiating a downhill slope or freestyle exhibition moves his body and shifts his weight to direct the snowboard as desired. Since all efforts to control and direct the snowboard are accomplished through the legs and feet, riders desire as much direct contact with the snowboard as possible, thereby ensuring that they can feel how the snowboard reacts to their movements.

At the same time, it is also desirable for the rider's feet to be secured firmly to the snowboard to ensure that his or her body movements are translated accurately into directed snowboard motion. In most snowboard bindings known to the art, a base plate is attached directly to the snowboard itself and forms an intermediate layer between the snowboard and the rider's boot.

However, at least three drawbacks hamper existing bindings which incorporate base plates between the boot and the snowboard. Base plates increase snowboard rigidity, diminish the rider's ability to feel and quickly respond to the snowboard's motion, and raise binding cost and complexity. When a snowboard is too rigid, it cannot bend in response to contours in the snow, thereby diminishing its responsiveness and generally making the snowboard more difficult to control. Increased response times can put the rider into potentially dangerous situations, where split-second response times are even more important.

In the few prior art snowboard bindings that do not require an underfoot base plate, the bindings have been rigidly mounted in place, and, therefore, will not securely accommodate the rider's boots in a variety of positions at his or her preference.

When riding a snowboard, the rider's feet are generally positioned across the long axis of the snowboard in much the same way that one would ride a skateboard. Among riders, however, there are various preferences over the preferred position of the feet. While some riders point their feet toward opposite ends of the board, others prefer a toe-in stance. Still others prefer to orient the feet in parallel across the board's length or at another angle.

What is desired therefore, is a snowboard binding that allows a rider to feel the board beneath the feet, and that gives a rider more choice than is presently available with respect to the position and angle at which the bindings are mounted.

SUMMARY OF THE INVENTION

A binding for securing a rider's boot to a snowboard at a desired position and angle includes a base that does not come between the boot and the snowboard, and a novel mount adjustably fastened to the base which secures a boot restraint to mounting holes in a snowboard. Unlike most snowboard bindings, a binding constructed in accordance with the present invention does not require a base plate between the rider's foot and the snowboard, and thereby allows the rider to sense and respond to the motion of the snowboard more easily than is possible with existing snowboards. Moreover, the binding of the present invention can be mounted to the snowboard in numerous orientations, allowing the rider to secure each foot independently to the snowboard as desired.

It is an object of the present invention to provide a snowboard binding, the mounting of which is adjustable with respect to its horizontal and vertical positions, and which is further adjustable with respect to its angularity and width.

It is another object of the present invention to provide an inexpensive snowboard binding that may be produced from a single sheet of bent rigid material.

It is yet another object of the present invention to provide a snowboard binding that may be easily adjusted in any of the above-noted respects while mounted and in use.

DETAILED DESCRIPTION OF THE INVENTION

In this application, references made to front and back of a foot or of a binding are made with respect to toe (front) and heel (back). However, the front foot refers to the foot closer to the bottom of the hill during downhill descent. Inner (or inside) and outer (or outside) are determined with respect to the arcuate boot restraint described herein. Objects described as outside the boot restraint are not within the area to be occupied by a rider's foot. Upper (or top) and lower (or bottom) are determined with respect to the snowboard. The lower portion of the snowboard is the portion principally in contact with the snow during use.

Figure 1:
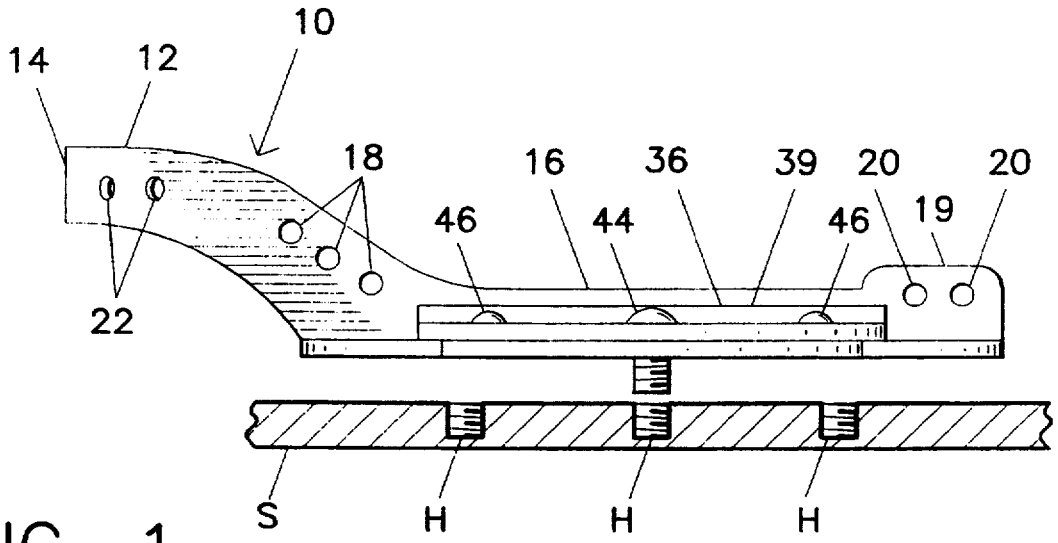
FIG. 1 shows a snowboard binding designed in accordance with the present invention. The binding is shown above a snowboard having a plurality of mounting holes.
Figure 2:
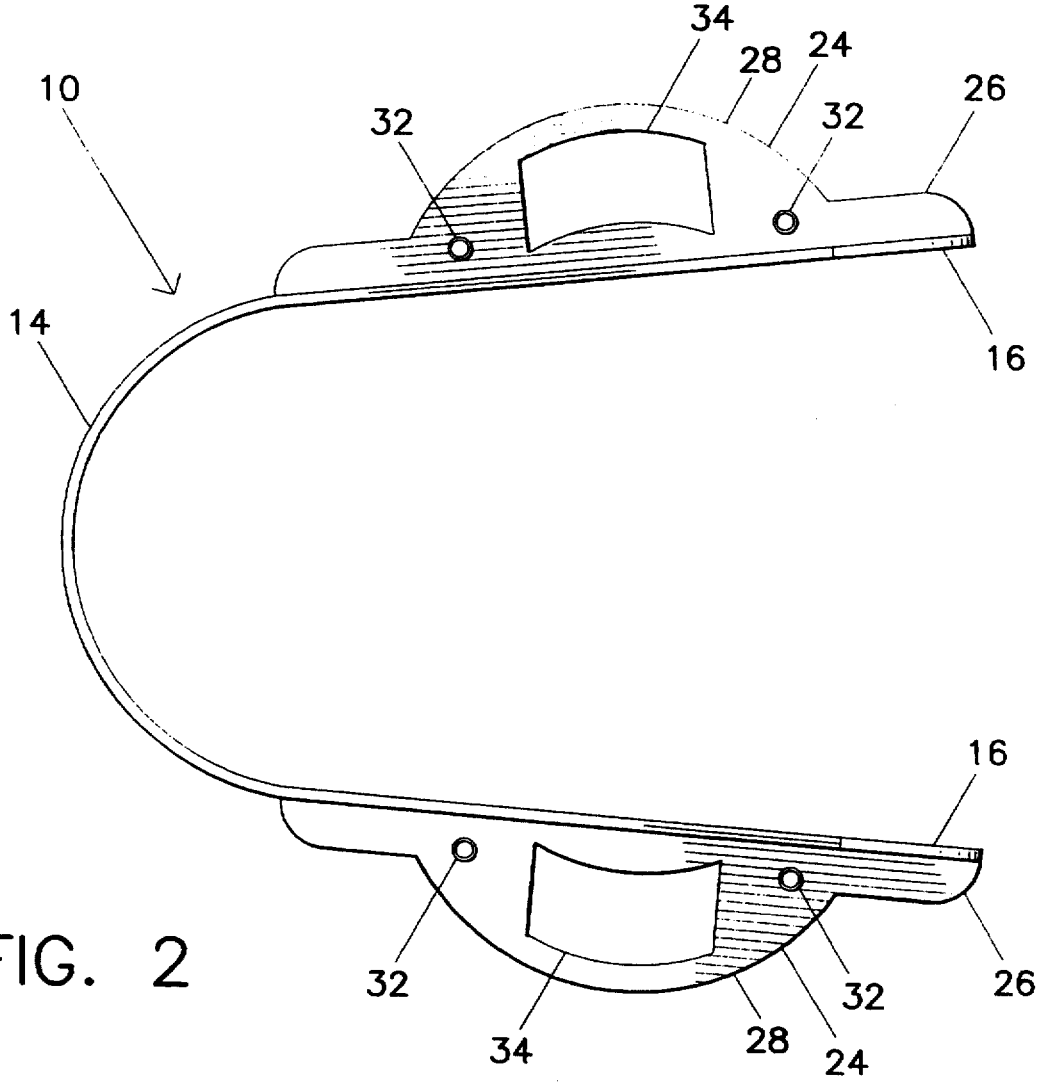
FIG. 2 is a top view of the preferred embodiment of the present invention, showing the arcuate heel-engaging back portion, two side arms extending from the back portion and the shoulders of the base.
Figure 3:
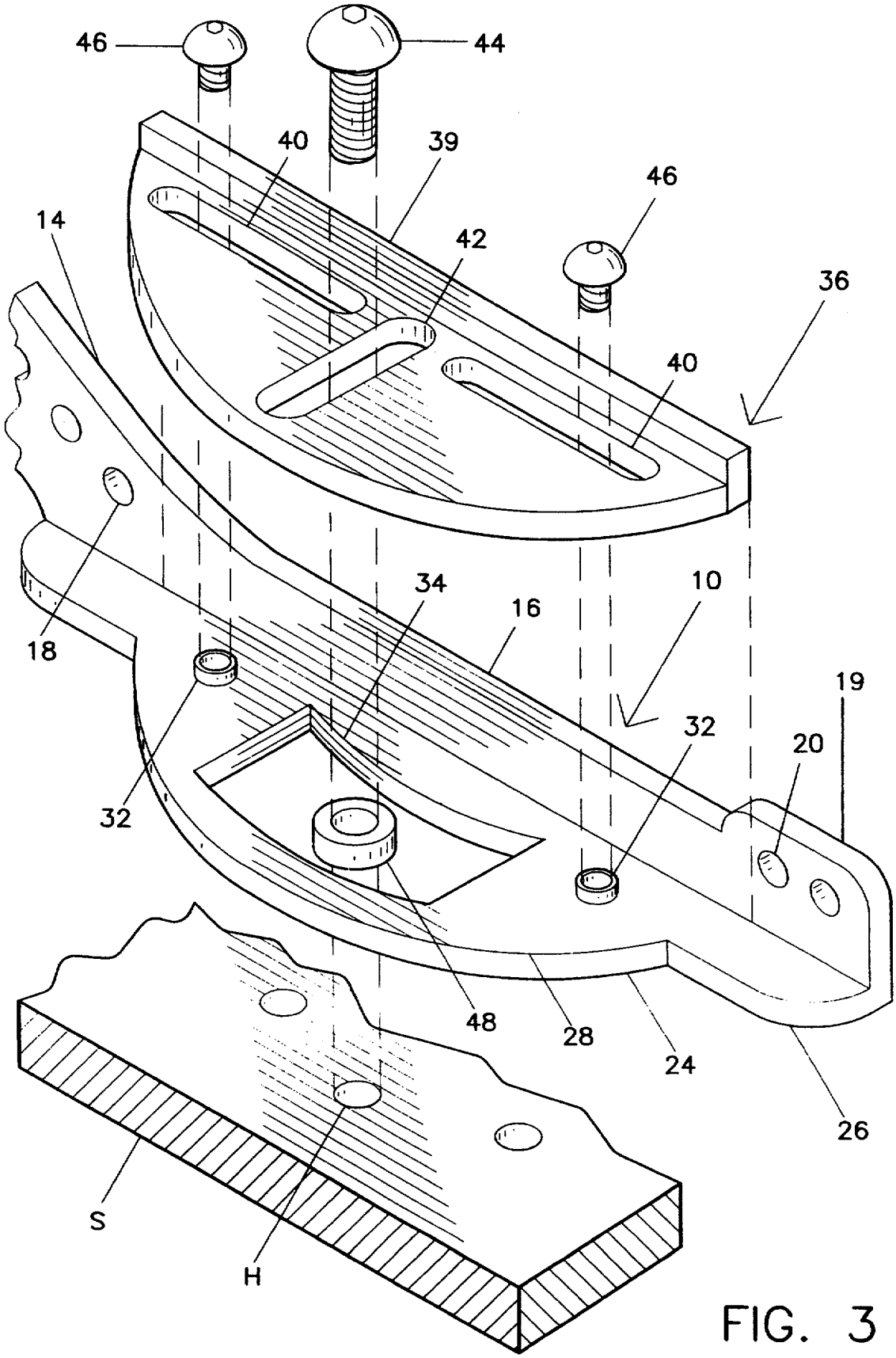
FIG. 3 details the mounting relationship among the shoulder plate, the locking plate, and the snowboard.

Shown in FIGS. 1–3 is the preferred embodiment of a snowboard binding 10 designed in accordance with the present invention for mounting to mounting holes H in snowboard S. Identical bindings 10 are provided for each foot. The following detailed description generally describes the binding 10 in terms of only one foot.

The binding 10 includes a boot restraint 12 formed in a roughly arcuate shape. The function of the boot restraint 12 is to secure the rider's boot in place while the snowboard is in motion. Many possible alternative structures may be envisioned that do so. In the preferred embodiment, the roughly arcuate shape is formed of an arched semicircular heel-engaging back portion 14 and a pair of side arms 16. Preferably, though not essentially, the side arms 16 are simply an extension of the back portion 14. At the closed end of the arch, the back portion 14 of the boot restraint 12 is swept up in a semicircular fashion from the bottom plane of the binding 10 that engages the snowboard. This permits a secure engagement of the rider's heel in the binding 10. As shown in FIG. 2 the side arms 16 extend outward from the back portion 14 at an angle, such as an angle of about 25°, relative to each other.

Boot fasteners may also be provided on the boot restraint 12 to hold the boot firmly to the binding and to minimize undesired movement of the rider's feet in the bindings. In the preferred embodiment, for example, the boot is conveniently fastened to the binding by passing one or more securable ankle straps (not shown) through a series of holes 18 provided on the side arms 16. Also, at the front end of each side arm 16 is a tongue 19 having holes 20 for securable toe straps (not shown). In addition, near the top center of the back portion, holes 22 are preferably provided for attaching highbacks. Highbacks are standard snowboard binding accessories which permit the rider to control the snowboard's motion using his lower legs. More or fewer holes of a sort known to the art may be added to the boot restraint, as needed, to ensure a secure connection between the binding and the boot for adequate control by the rider.

When mounted to a snowboard, a substantially planar rigid base of the binding engages the top of the snowboard. Because of the desire to "feel" the snowboard beneath the rider's feet, the base is not interposed between the rider's foot and the snowboard. The base is, therefore, preferably formed as a pair of separate, identical planar shoulders 24 joined to the side arms 16, with one shoulder 24 being substantially perpendicularly joined toward the outside of each side arm 16. The profile of the shoulders are preferably kept small, to ensure that no portion of the binding extends over the edges of the snowboard when the binding is mounted at an angle. A narrow, substantially rectangular planar portion 26 of the shoulder 24 perpendicularly abuts the bottom of each planar side arm 16 along its entire length, while a curved semicircular portion 28 of the shoulder 24 extends outward from, and in the same plane as, the rectangular portion 26. The narrow rectangular portion 26 adds strength to the shoulder 24, yet does not markedly increase the overall size of the binding. The curved portion 28 is preferably not appreciably larger than is necessary to engage a novel locking plate, described below. The novel base, in conjunction with a novel locking plate described below, permits attachment of the binding at many positions and angles of the snowboard.

In the preferred embodiment, the top of the curved portion 28 of each shoulder 24 includes a pair of raised posts, such as internally threaded cylindrical pegs 32, fixed equidistant from the side arm 16 and placed to either side of a central opening 34 in the shoulder 24. The central opening 34 may extend, in part, from the curved portion 28 into the rectangular portion 26. The central opening 34 must be sufficiently large to permit the binding 10 to be pivoted freely about a fastener passed therethrough and mounted to the snowboard. The movements of the binding about the mounted fastener are described elsewhere in this specification. Preferably, the longer sides of the central opening 34 are curved to accommodate and to maximize the movements of the binding.

Of course, the base may be configured in any other manner that does not diminish a rider's ability to feel the board and to adjust the binding of the present invention into a range of orientations relative to the snowboard as described herein.

The locking plate 36 is positioned in a slidably securable manner atop the base, and is preferably shaped to complement the narrow profile of the base as described. Two locking plates are needed for each binding. The locking plate works coordinately with the base, and with the plurality of mounting holes in the snowboard to permit the rider to select a position and an angle that is comfortable and appropriate to the terrain. The locking plate 36 is planar and roughly semicircular like the shoulder on which it engages. Along the longer dimension, at the edge of the locking plate 36 that rests against the side arm 16, as shown best in FIG. 3, is a planar portion 39, perpendicular to the semicircular portion of the locking plate 36, which provides stability and support to the locking plate 36.

Provided along the longer dimension of the locking plate 36 are first and second collinear slots 40 that slidably receive the base pegs 32. A third slot 42, located between and substantially perpendicular to the collinear slots, receives a fastener 44 that fastens the binding and locking plate to the snowboard. The fastener 44 may be any kind of fastener that provides a secure connection to the snowboard, and is preferably easily adjustable, for on-the-fly tuning of the bindings during use. Acceptable fasteners include, for example, thumbscrews or allen screws.

The entire binding 10, with the exception of the removable locking plates 36, may be stamped from a single piece of bendable solid material, then shaped as desired or, alternatively, may be assembled from a number of separate parts joined together in keeping with the invention as herein disclosed. Single piece construction is preferred because this allows the binding to be produced at relatively low cost and with a minimum of parts. The preferred solid material is sheet metal, most preferably aluminum, which, while quite rigid, is also lightweight as well as flexible enough to permit adjustment of the binding for a variety of boot sizes. Once formed, the binding would likely be coated or otherwise modified to enhance its appearance.

Figure 4:
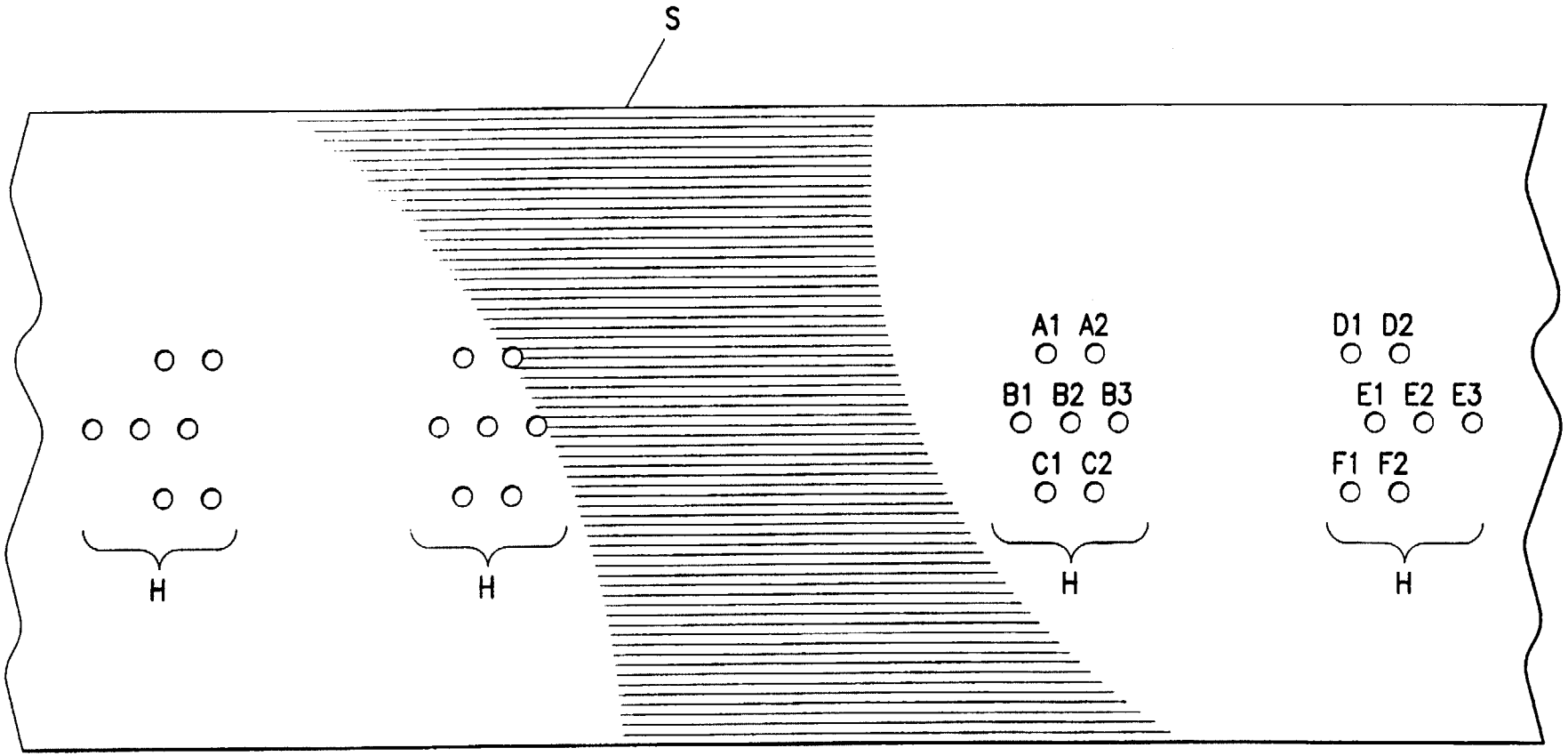
FIG. 4 shows, schematically, a snowboard provided with mounting holes advantageously arranged for use with the binding of the present invention.

The binding of the present invention is designed to be mounted onto a snowboards provided on its upper surface with a plurality of pre-drilled mounting holes H. For maximal flexibility, the mounting holes H are preferably arranged as shown in FIG. 4. FIG. 4 shows the preferred mounting hole arrangement for the rider's feet, in which the heel-engaging back portions 14 of the bindings 10 of the front foot would be situated at the bottom. For the rear foot, the mounting holes provided are in the horizontal mirror image of those of the forward foot. As such, when both bindings are mounted, the heel-engaging back portions 16 are nominally situated toward one edge of the snowboard, with the rider's toes facing toward the opposite edge.

The general position of the binding is set by choosing one pair of mounting holes. However, because the snowboard is provided with a plurality of mounting holes H for each binding 10, each foot may be positioned and angled independently, allowing any rider to achieve a suitable stance and stance width. The novel construction disclosed herein permits significant additional fine-tuning of the binding positions and angles after mounting. Fine tuning is simple enough to be performed on the slope before, during or after a run.

The preferred mounting hole arrangement includes a left group and a right group for each foot, where each group includes three rows of holes, namely two rows of two holes and a row of three holes therebetween. When the binding 10 is mounted, a single hole selected from one row of the left group accepts a fastener passed through the left side of the binding, and a single hole selected from a complementary row of the right group accepts a fastener passed through the right side.

Reference to FIG. 4 shows the labelled complementary rows of left and right holes for the front foot, with the holes of each matching pair being a constant distance apart. For purposes of this disclosure, the rows in each group are lettered (A, B, C, D, E, or F) and matching holes in complementary rows are numbered similarly (1, 2, or 3). Therefore, pairs of mounting holes to which the binding may be mounted may now be uniquely identified by reference to their row and hole numbers. In keeping with this scheme, Table 1 lists the pairs of matching holes that can readily receive fasteners, as described.

TABLE 1

| |
|---|
| A1-F1 |
| A2-F2 |
| B1-E1 |
| B2-E2 |
| B3-E3 |
| C1-D1 |
| C2-D2 |

Selection of a pair of holes is made according to the rider's stance preference. The choice of a pair of matching mounting holes from complementary rows determine the general positions of the mounted bindings along the front-to-back (long axis) and side-to-side (short axis) of the snowboard. The general position of each foot in the binding may be expressed in terms of the direction in which the toes point. To orient the toes perpendicular to the long axis of the snowboard, one of the B-E pairs should be chosen. To point the toes of the forward foot toward the rear of the snowboard (at left in FIG. 5), one of the A-F pairs is preferred, while the C-D pairs should be chosen to point the forward foot toward the front of the snowboard. Because the preferred rear foot mounting holes are disposed in the mirror image of the front foot holes, these instructions are to be reversed when orienting the rear foot. The rider's choice of holes 1, 2, or 3 within the chosen row of lettered pairs is made in order to increase or decrease the distance between the feet.

It has been determined that the arrangement of FIG. 4 enables the most common rider stances, shown in Table 1, to be achieved with minimal complexity and adjustment. However, FIG. 4 and Table 1 merely demonstrate a preferred mounting hole arrangement and a preferred series of connection options. The disclosed connection options are not intended to exclude other connections possible using the mounting hole arrangement of FIG. 4. Other connections may be achieved by narrowing or increasing the distance between the side arms 16. There is no inherently preferred absolute distance between holes or between the left and right groups, except that among the many pairs of left and right holes, the holes are all equally spaced. The absolute distance will, of course, vary with the size of the binding and the size of the snowboard and may, therefore, readily be empirically determined by one of ordinary skill.

Further, the invention is not intended to be limited to bindings that utilize the particular mounting hole arrangement shown. The binding of the present invention may be installed on snowboards having more, or fewer, mounting holes, arranged in other configurations, which would, of course, offer more or fewer options for the rider. Indeed, it is not necessary to provide any pre-drilled mounting hole arrangement at all. The binding still offers novel angular adjustability when installed into a single pair of holes provided by a user. In that case, however, it would be necessary to drill additional mounting holes each time the user desires to change the overall position of the bindings relative to each other (e.g., to change the distance between the feet).

After the desired matching pair has been selected, the locking plates 36 are placed atop the shoulders 24 of the base, with one post 32 passing through each of the collinear slots 40. The locking plate 36 is loosely secured atop the base by securing the posts with caps 46, such as screws that threadably engage the pegs 32, the width of the caps 46 being greater than that of the collinear slots 40. The loosely attached locking plate 36 may then slide freely back-and-forth along the line defined by the posts 32 that pass through the slots 40. The fastener 44 is then passed through the third slot 42 and through an optional spacer 48 in the central opening 34 of the base until it engages one of the mounting holes H. The spacer 48 prevents the locking plate 36 from distorting when the fastener 44 is tightened.

To realize the most advantageous benefit of the binding of the present invention, however, the binding should be fine-tuned in one, or more, of three possible ways before fully tightening the fastener 44, to achieve the precise position and angle desired by the rider. This extensive maneuverability, previously unknown to the art, may be achieved because although the locking plates 36 are secured to the snowboard, the base openings 34 beneath the locking plates 36 are large enough to facilitate free movement of the binding 10. Forward-backward binding motion is directed by the posts 32 in the collinear slots 40. Side-to-side binding compression or expansion, to accommodate boots of various widths, is also possible and such movement is governed by slot 42. The binding may also be pivoted approximately 45° about the axes formed by the loosely secured fasteners. It is noted that at maximum angularity, however, the stress of the bindings may be sufficiently great as to decrease somewhat their effectiveness. Most advantageously, these three adjustments are independent and may, therefore, be combined to optimize boot fit, position and angle. Moreover, these adjustments may be performed independently for each foot. To perform the fine-tuning, the fasteners holding the bindings in place are unfastened until such time as the binding may be moved but the fastener remains engaged in their mounting holes. After making all desired adjustments, the fasteners are again fully secured. By virtue of this single two-point adjustment, this binding allows a rider to readjust the bindings as needed, without requiring the rider to leave the slope or to remove the bindings.

It is understood that the invention is not intended to be limited to the embodiment disclosed herein, but shall embrace all such modifications as fall within the scope of the following claims.

We claim:

1. A binding for securing a snowboard rider's boot to a snowboard having a plurality of mounting holes thereupon, the binding comprising:

a boot restraint comprising a heel-engaging back portion and having a pair of side arms, each side arm extending outward from one end of the back portion;

a base, formed as two outwardly extending portions of the side arms whereby the boot is in direct contact with the snowboard upper surface, each portion of the base having an opening therethrough and having a pair of securable posts fixed thereto, with the posts being fixed equidistant from the side arm and with one post being fixed on either side of the opening;

a pair of locking plates, one locking plate slidably securable to each base portion and adjustably mountable to the mounting holes of the snowboard, each locking plate having a pair of collinear first and second slots slidably engagable on the posts and having a third slot located between and substantially perpendicular to the collinear slots and situated such that, when the locking plates are slidably secured to the base portions, each locking plate may be removably fastened to the snowboard by passing a fastener through the third slot and through the opening into one of the mounting holes.

2. A binding as claimed in claim 1 wherein the back portion is arcuate in shape.

3. A binding as claimed in claim 1 wherein the locking plates and base portions are semicircular.

4. A binding as claimed in claim 1 wherein the side arms have a plurality of holes formed therein to support a strap for securing the boot.

5. A binding as claimed in claim 1 wherein the binding is formed of sheet metal.

6. A binding as claimed in claim 5 wherein the sheet metal is aluminum.

* * * * *